US009777501B2

(12) United States Patent
Rossi

(10) Patent No.: US 9,777,501 B2
(45) Date of Patent: Oct. 3, 2017

(54) STRUCTURE FOR CONTAINING CINERARY URNS AND FURNERARY ITEMS IN GENERAL

(71) Applicant: BIONDAN NORTH AMERICA INC., Toronto, Ontario (CA)

(72) Inventor: Filippo Rossi, Isola Della Scala (IT)

(73) Assignee: BIONDAN NORTH AMERICA INC., Toronto, Ontario (CA)

( * ) Notice: Subject to any disclaimer, the term of this patent is extended or adjusted under 35 U.S.C. 154(b) by 0 days.

(21) Appl. No.: 14/982,865

(22) Filed: Dec. 29, 2015

(65) Prior Publication Data

US 2017/0183889 A1 Jun. 29, 2017

(51) Int. Cl.
*E04H 13/00* (2006.01)
*A61G 17/08* (2006.01)

(52) U.S. Cl.
CPC ..... *E04H 13/008* (2013.01); *A61G 17/08* (2013.01)

(58) Field of Classification Search
CPC .... A61G 17/08; E04H 13/006; E04H 13/008; A47B 87/0276; A47B 87/0284; A47B 87/0292; B65D 21/0201
USPC ..... 27/1, 35; 52/134, 136; 211/85.27; 312/111; 220/4.27
See application file for complete search history.

(56) References Cited

U.S. PATENT DOCUMENTS 4,614,066 A * 9/1986 Koppenberg ..... E04H 13/006 312/111
5,477,594 A * 12/1995 LePage ..... E04H 13/006 211/194
6,105,315 A * 8/2000 Stoecklein ..... E04H 13/006 27/1
6,161,268 A * 12/2000 Joseph ..... E04H 13/008 27/1
6,167,600 B1 * 1/2001 Williams ..... E04H 13/006 27/1
7,591,053 B2 * 9/2009 Bosisio ..... E04H 13/008 211/85.16
7,908,800 B2 * 3/2011 Bach Lahor ..... E04H 13/006 211/85.27
2010/0275529 A1 * 11/2010 Bridgemen ..... E04H 13/006 52/134
2011/0154748 A1 * 6/2011 Young ..... E04H 13/006 52/136
2015/0308141 A1 * 10/2015 Ugartechea Berlanga ..... A61G 99/00 52/135

* cited by examiner

*Primary Examiner* — William Miller
(74) *Attorney, Agent, or Firm* — Koppel, Patrick, Heybl & Philpott

(57) ABSTRACT

A structure for containing cinerary urns and funerary items in general, which comprises a plurality of modular elements, such modular elements comprising: a plurality of box-like bodies, each one defining, within it, at least one niche for accommodating at least one cinerary urn and/or at least one funerary item and having a front face which is provided with at least one access opening; a plurality of elements for mutually joining such box-like bodies, which have at least one connecting portion adapted to be fixed to the front face of the box-like bodies arranged mutually adjacent; a plurality of profiled finishing elements designed to cover such joining elements at least partially; a plurality of retention bodies designed to be fixed with respect to such box-like bodies and adapted to peripherally engage closing plates, which are respectively intended for closing the openings of such box-like bodies.

11 Claims, 16 Drawing Sheets

STRUCTURE FOR CONTAINING CINERARY URNS AND FURNERARY ITEMS IN GENERAL

BACKGROUND OF THE INVENTION

Field of the Inventions

The present invention relates to a structure for containing cinerary urns and funerary items in general.

DESCRIPTION OF THE RELATED ART

Structures are known for containing cinerary urns or other funerary items, such as funerary lights, photo frames and the like, which are constituted by a frame provided by a plurality of box-like bodies made of metal or other material, arranged mutually side by side, each one of which defines a corresponding burial niche or recess for accommodating the cinerary urns, and is closed at the front of the structure with a sheet of glass or other material.

Current structures are assembled at the factory by joining the several box-like bodies by way of screws, which are screwed from the inside of the niches, in order to fix joining profiles.

As a consequence, the provision of current structures is rather laborious and inconvenient to carry out, even by expert labor, and, furthermore, it requires the transport of the pre-assembled structures, which, owing to the dimensions and the fragility of some parts of the structures thus provided, is rather complex and costly.

SUMMARY OF THE INVENTION

The aim of the present invention is to provide a structure for containing cinerary urns and funerary items in general which is composed of modular elements that can be assembled and which can be easily transported and which can, furthermore, easily be assembled in the place of end use by anyone.

Within this aim, an object of the present invention is to provide a structure for containing cinerary urns and funerary items in general which, although being modular, offers superior characteristics of strength.

Another object of the present invention is to provide a structure for containing cinerary urns and funerary items in general which has aesthetic characteristics comparable to those of traditional pre-assembled structures.

This aim and these and other objects which will become better apparent hereinafter are achieved by a structure for containing cinerary urns and funerary items in general, according to the invention, as defined in the claims.

BRIEF DESCRIPTION OF THE DRAWINGS

Further characteristics and advantages of the invention will become better apparent from the description of some preferred, but not exclusive, embodiments of the structure for containing cinerary urns and funerary items in general, according to the invention, which are illustrated, by way of non-limiting example, is the accompanying drawings wherein:

FIGS. 7 and 8 are respectively a cross-sectional view taken along the lines VII-VII and VIII-VIII in FIG. 6;

DETAILED DESCRIPTION OF THE INVENTION

Figure 1:
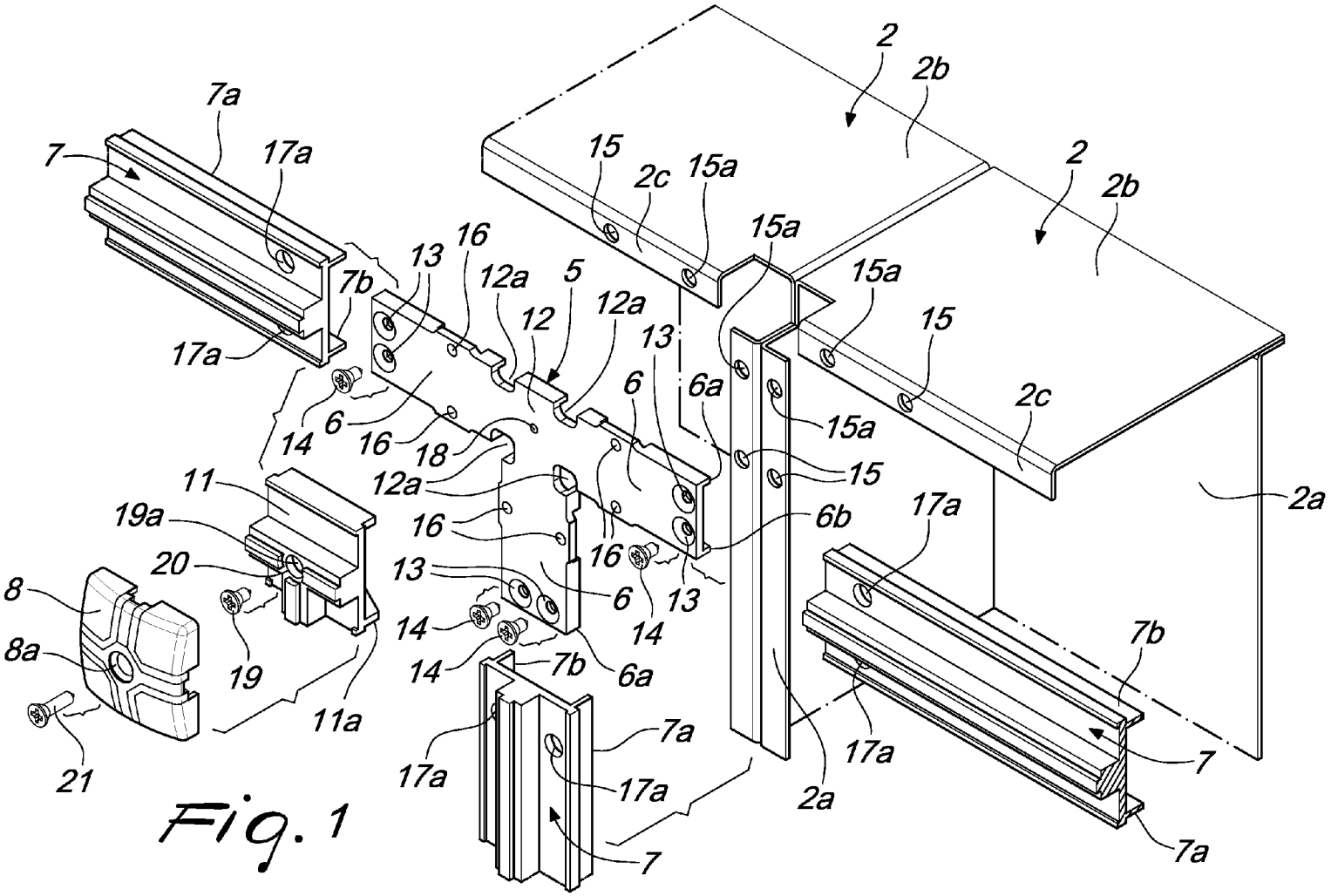
FIGS. 1 to 6 are exploded perspective views of a sequence of steps of assembling several modular elements of a structure according to the invention, some of which are shown partially cutaway.
Figure 2:
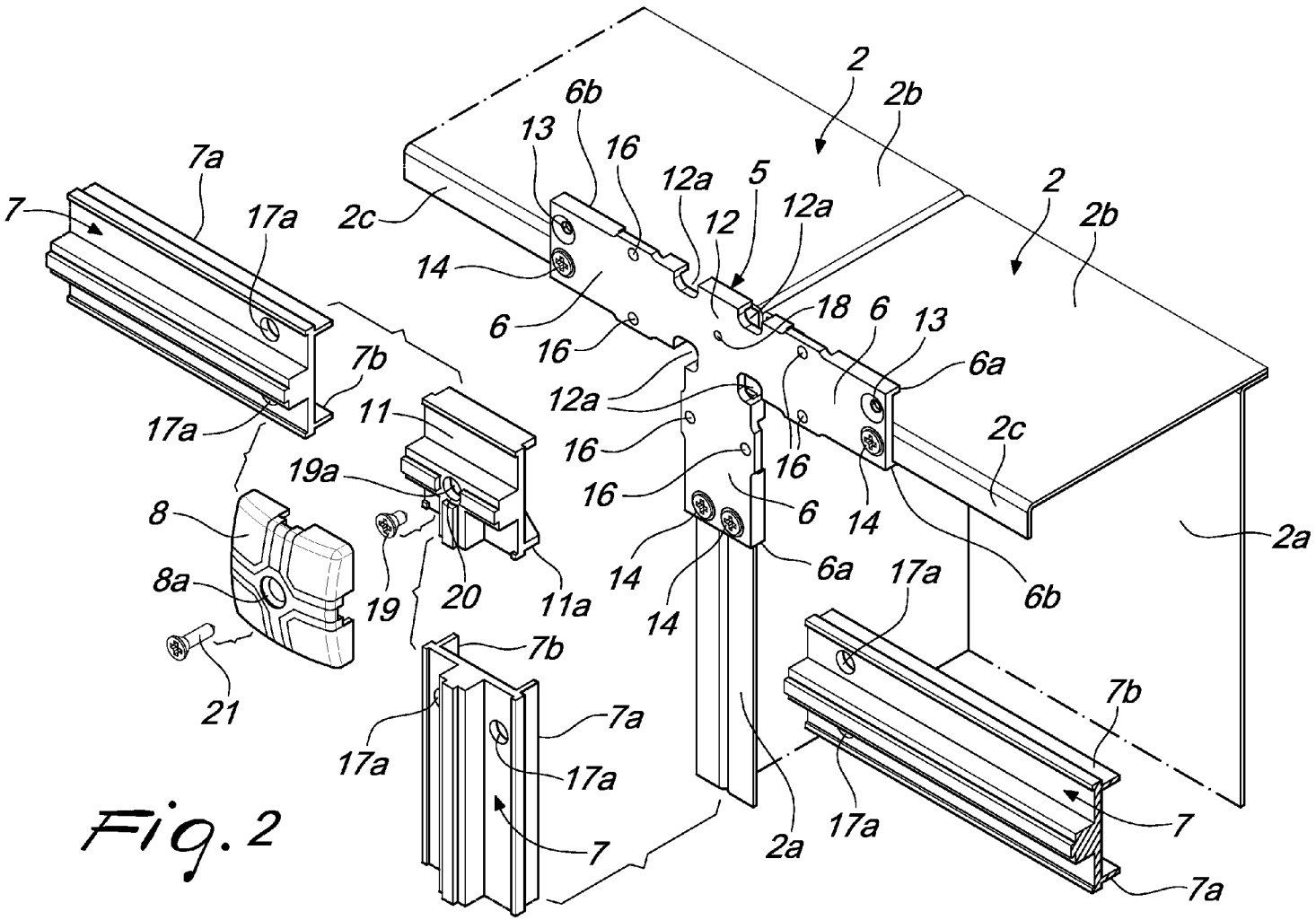
Figure 3:
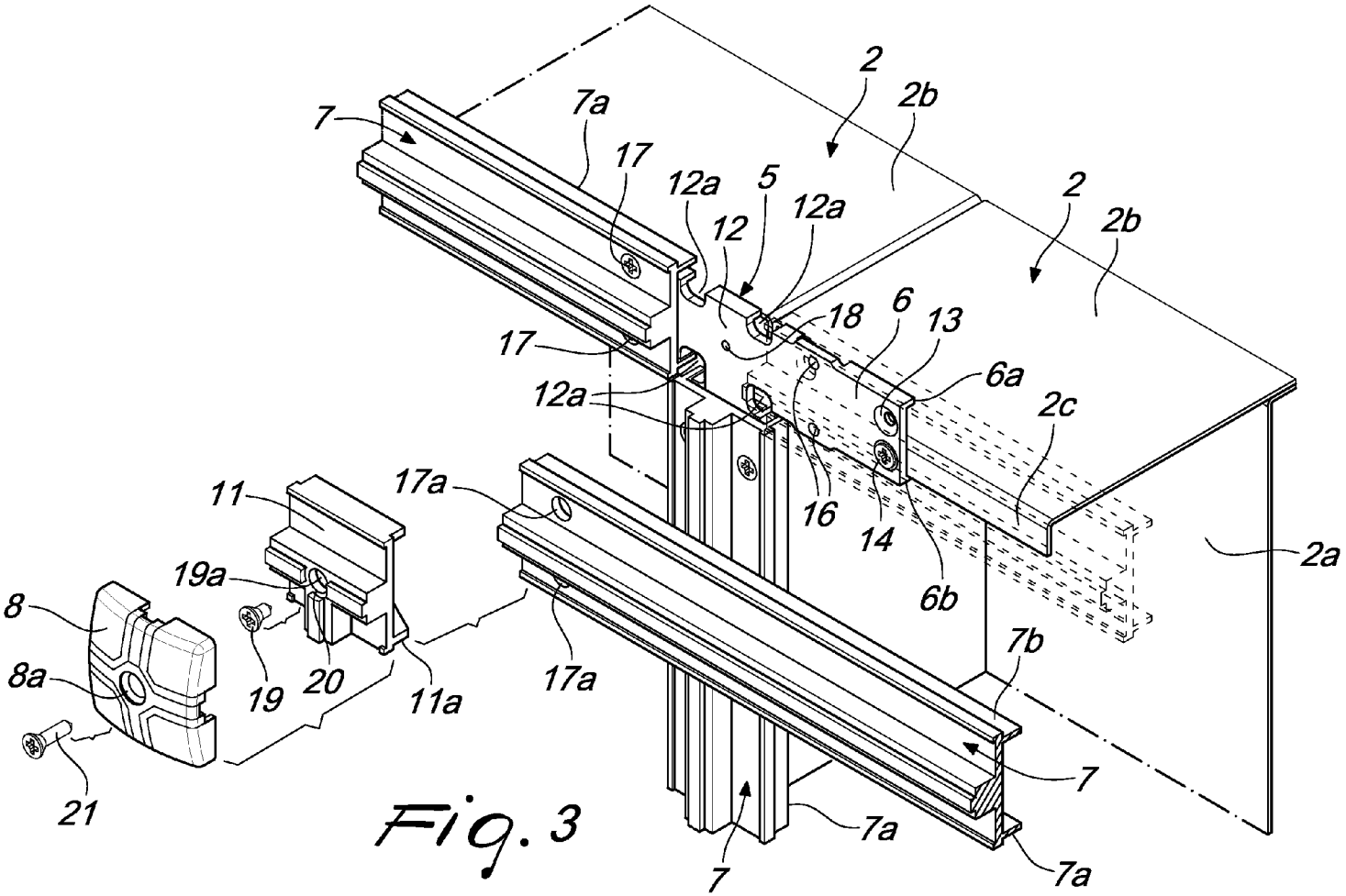
Figure 4:
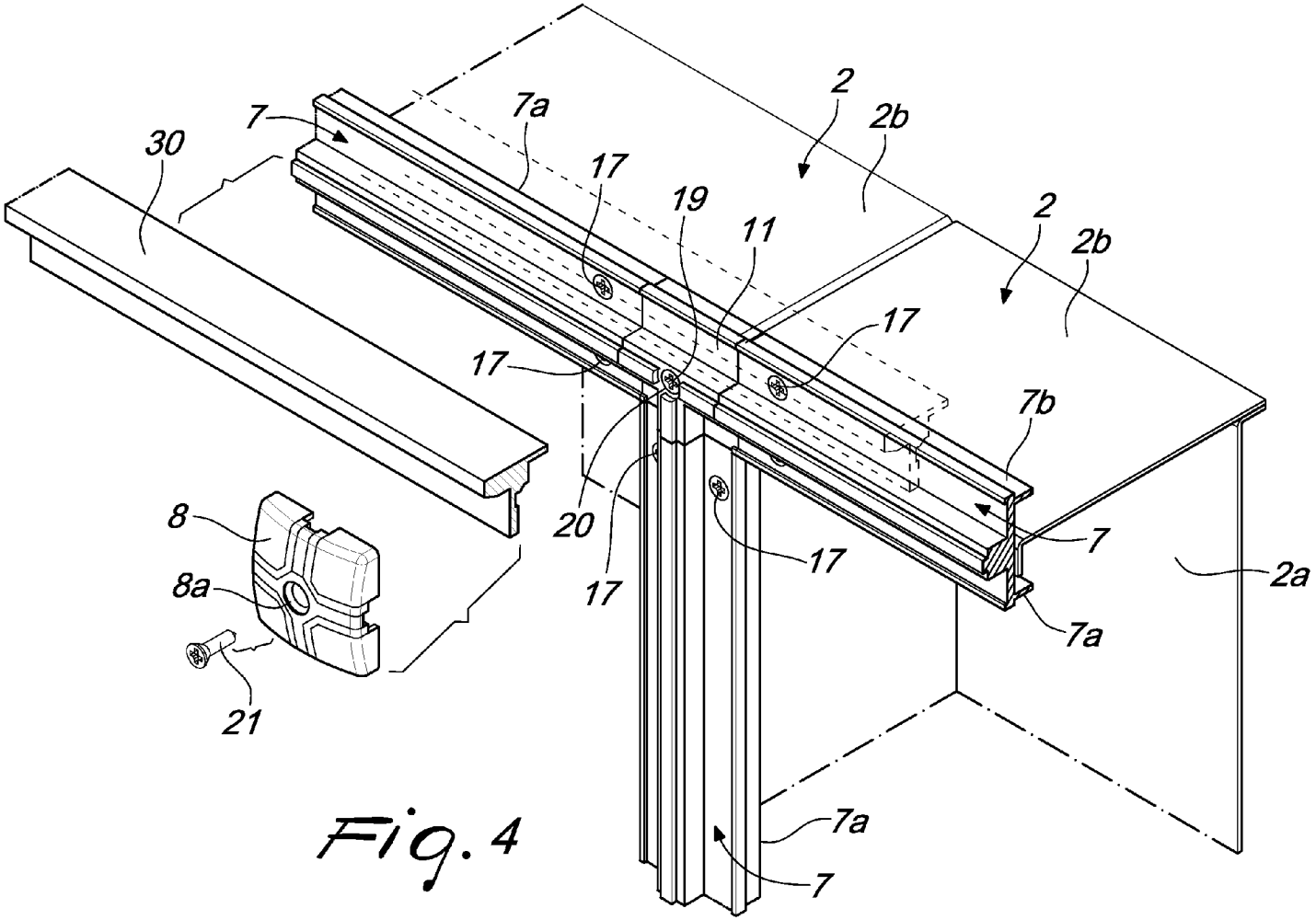
Figure 5:
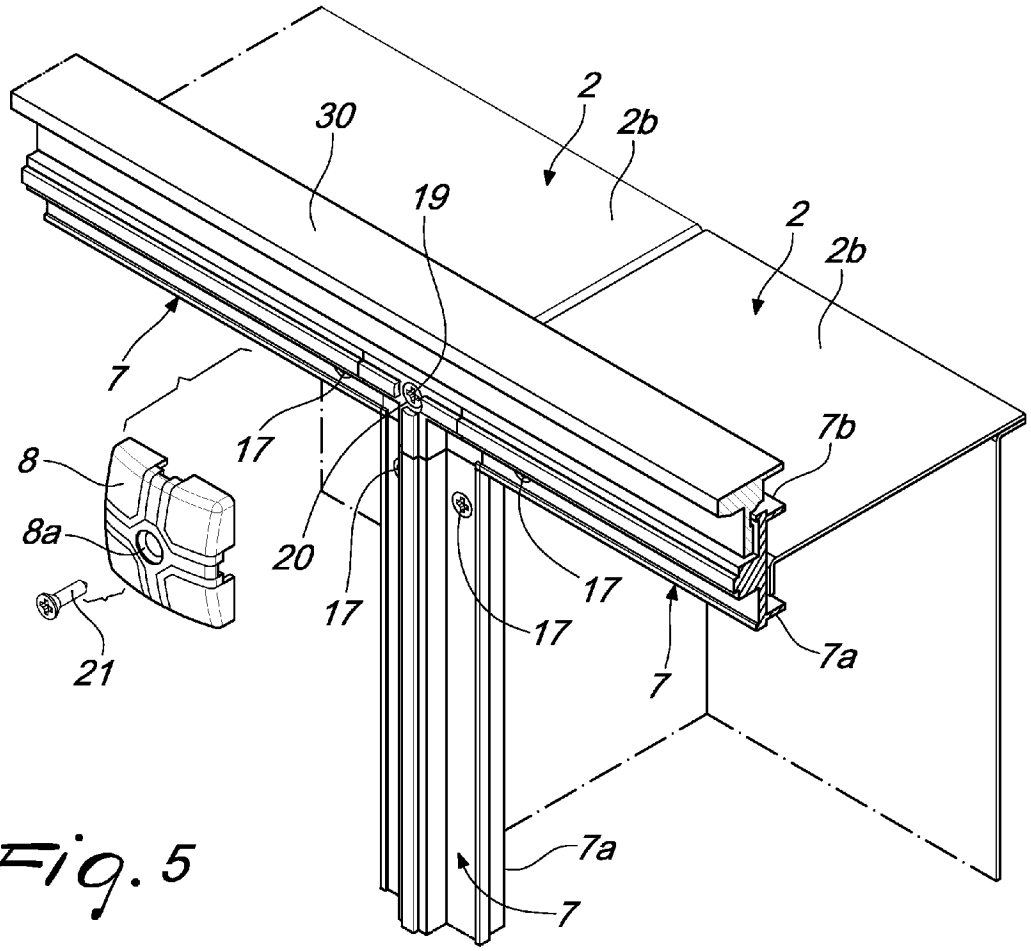
Figure 6:
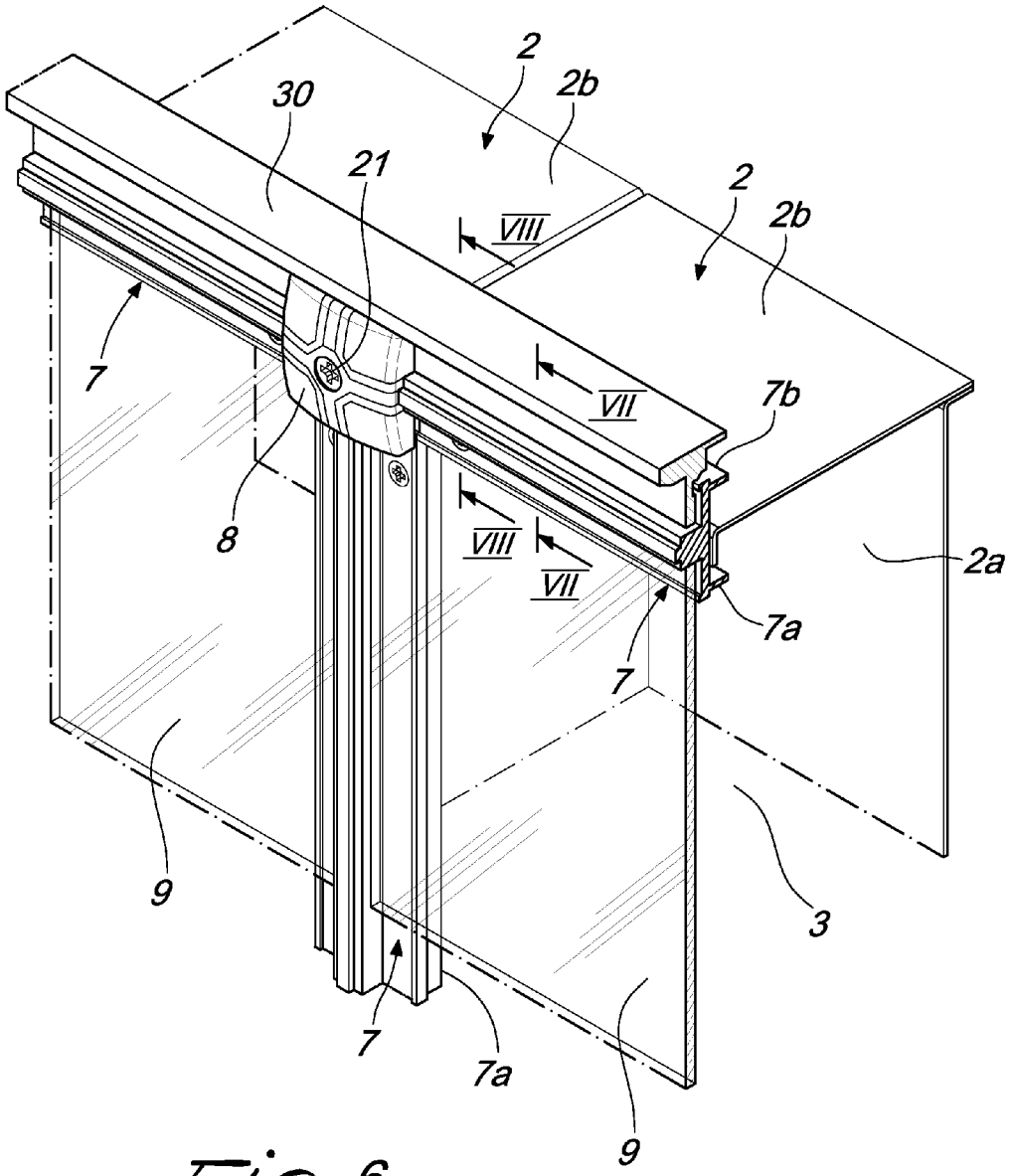
Figure 8:
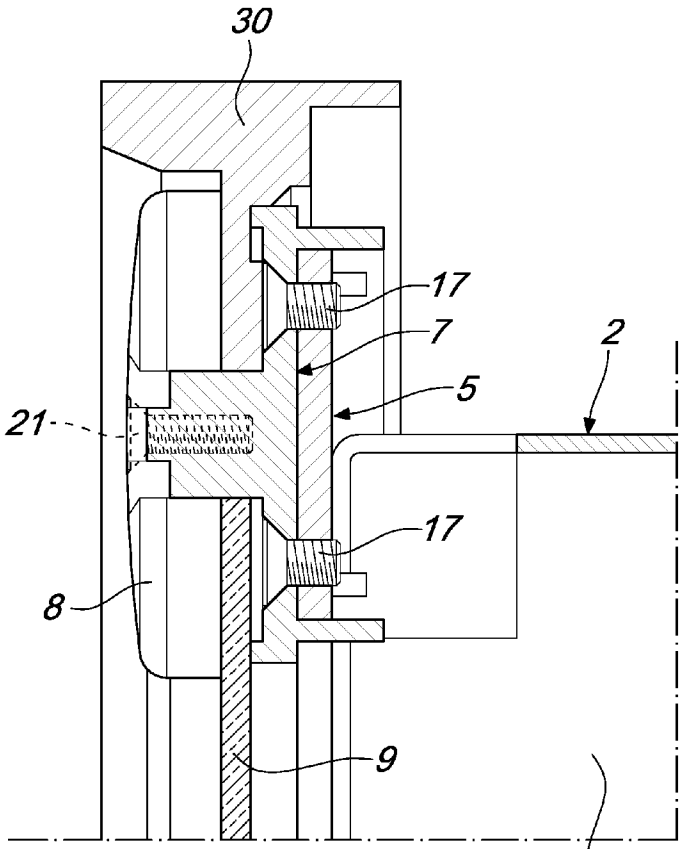
Figure 7:
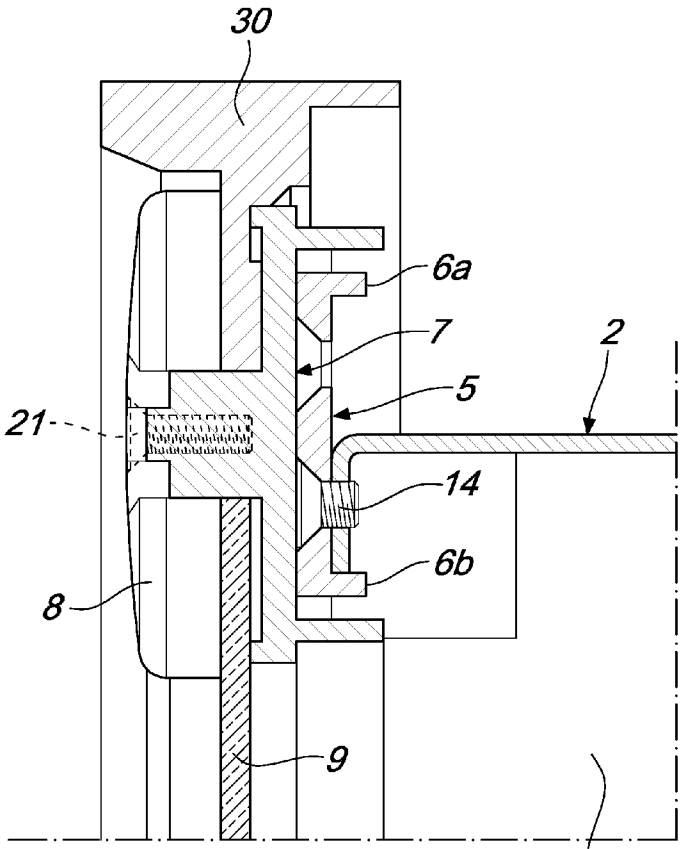
FIG. 7 is a cross-sectional view taken along the line VII-VII in FIG. 6.

With reference to the figures, the structure for containing cinerary urns and funerary items in general, according to the invention, generally designated with the reference numeral 1, comprises a plurality of modular elements that can be joined together, in order to provide the desired structure. With reference to the figures, the structure for containing cinerary urns and funerary items in general, according to the invention, generally designated with the reference numeral 1, comprises a plurality of modular elements that can be joined together, in order to provide the desired structure.

Such modular elements comprise box-like bodies 2, each one of which defines, within it, at least one niche 3 for accommodating at least one cinerary urn and/or at least one funerary item.

The box-like bodies 2 have, in particular, a rear face 2*a*, side faces 2*b* and a front face 2*c* which is provided with at least one access opening 4 to the corresponding niche 3. Optionally, it is possible for the rear face 2*a* to also be at least partially open.

As illustrated, the box-like bodies 2, made, advantageously, of sheet metal or other material, are designed to be arranged mutually adjacent, with their side faces 2*b*, along at least two mutually perpendicular directions, in particular a horizontal direction and a vertical direction, so as to be side by side and under and over, with respect to each other.

It must be noted that the box-like bodies 2 can, conveniently, be of mutually different dimensions and have, in general, a shape structure that is substantially parallelepiped or substantially cubic, according to requirements.

The box-like bodies 2 are connected to each other by way of a plurality of joining elements 5 which each have at least one connecting portion 6 which is adapted to be fixed to the front face 2*c* of the box-like bodies 2 which are arranged mutually adjacent. In this manner, the connection between the several box-like bodies 2 that make up the structure is quite simple in that it can be carried out on the front face thereof.

The modular elements of the structure according to the invention comprise, further, profiled finishing elements 7, the function of which is to cover, at least partially, the joining elements 5, so that, once the structure is finished, these elements are not visible, and retention bodies 8, which are intended to be fixed with respect to the box-like bodies 2 and are adapted to peripherally engage closing plates 9, which are made of glass or other material, such as for example marble, metal, agglomerate and so on, and are intended respectively to close the openings 4 of the box-like bodies 2.

Conveniently, as will be better described below, the joining elements 5 make it possible to fix the profiled finishing elements 7 and the retention bodies 8 to the structure.

The joining elements 5 are, advantageously, structured so that they can be fixed to corner areas 10 of the front faces 2*c* of the box-like bodies 2 and, in particular, they can be structured to mutually connect the corner areas 10 of the front faces 2*c* of the box-like bodies 2 which are arranged mutually adjacent.

More specifically, each one of the joining elements 5 has, conveniently, at least two connecting portions 6, which extend substantially at right angles to each other and each of which can be fixed to respective areas of the front face 2*c* of the box-like bodies 2 which are arranged mutually adjacent.

Preferably, the joining elements 5 have a plate-like structure and, depending on the number of connecting portions 6 they have, they can be various different shapes in plan view.

Figure 9:
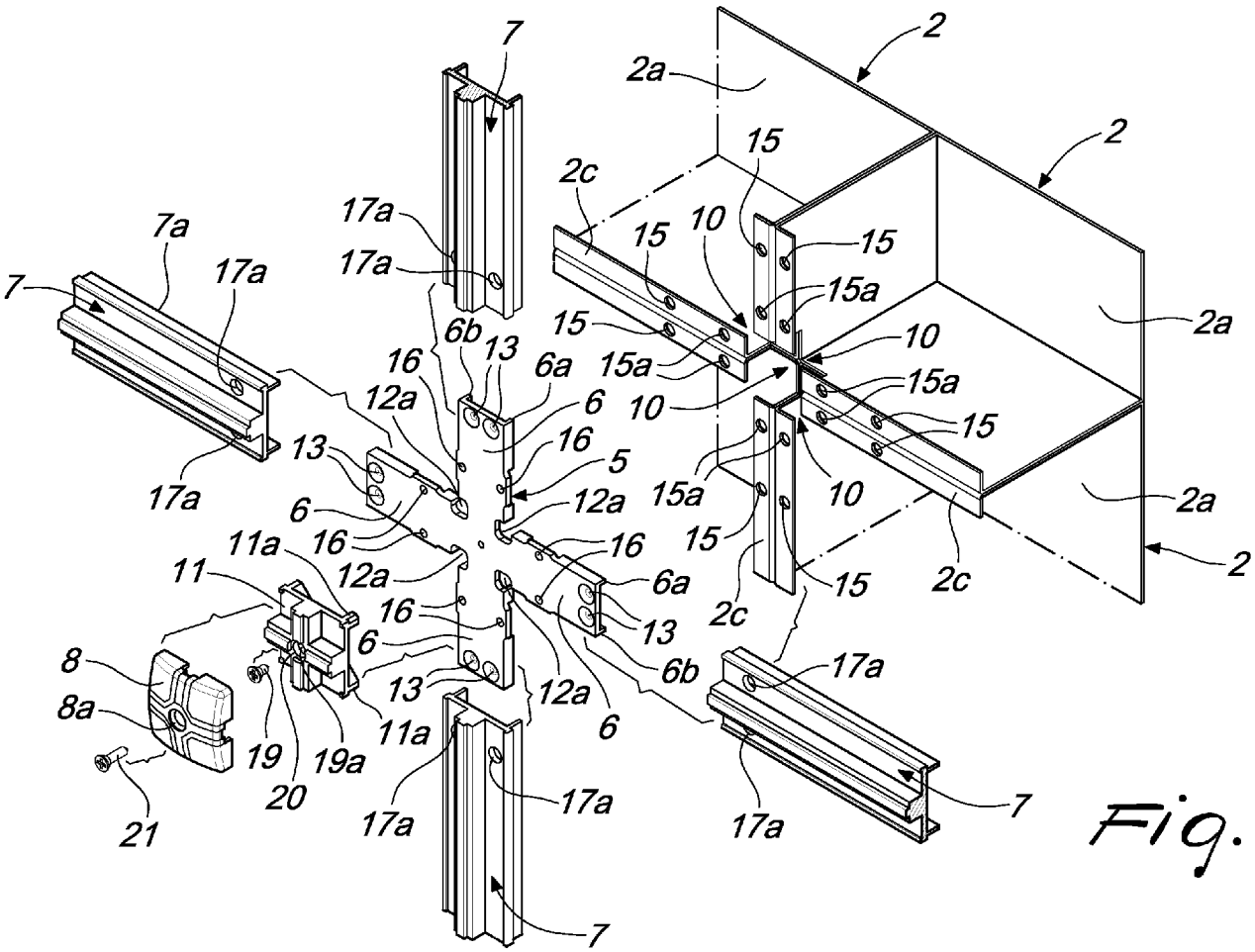
FIG. 9 is a partially cutaway exploded perspective view of a portion of the structure according to the invention.
Figure 10:
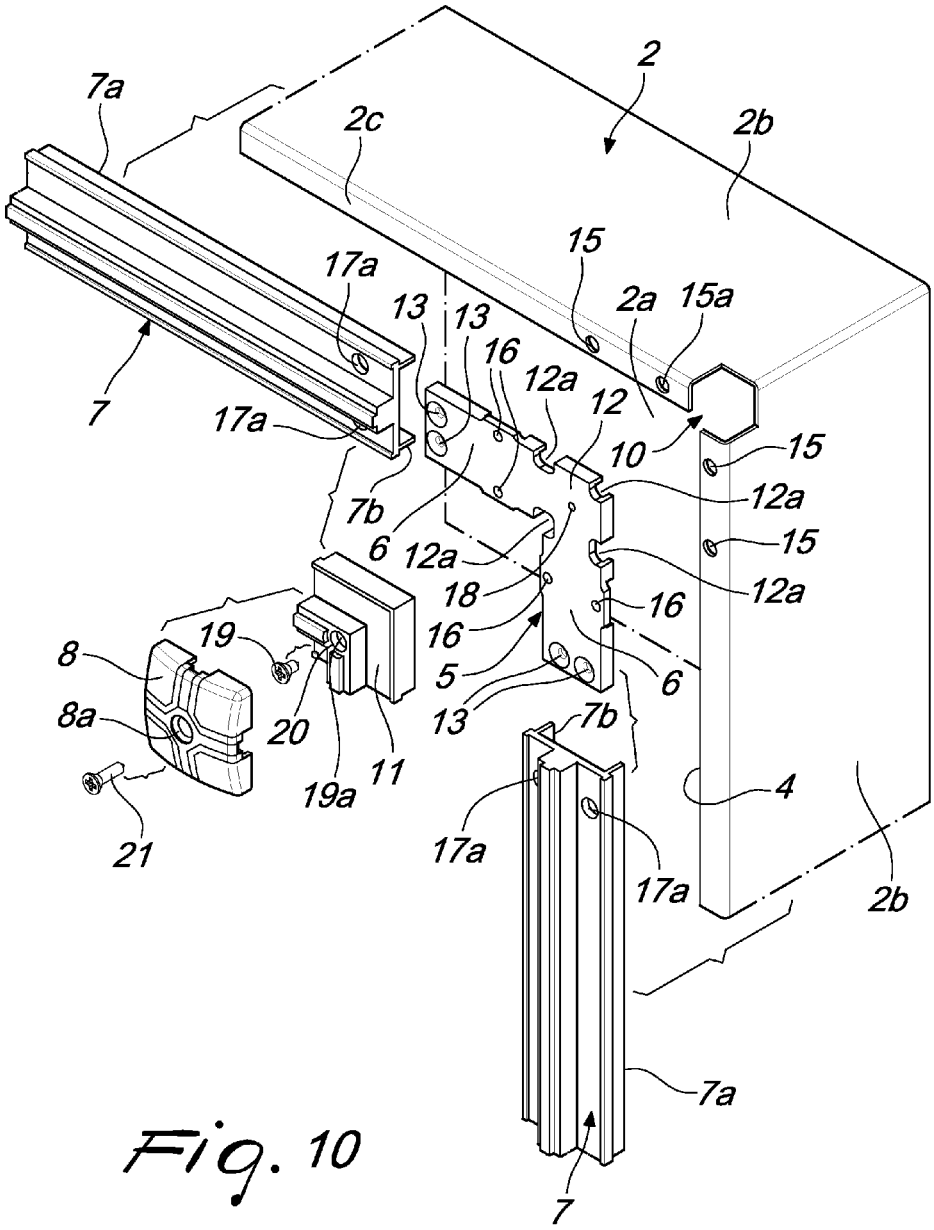
FIG. 10 is a partially cutaway exploded perspective view of another portion of the structure according to the invention.

For example, there can be: joining elements 5 with two connecting portions 6 and substantially L-shaped, like the one shown for example in FIG. 10; joining elements 5 with three connecting portions 6 and substantially T-shaped, like the one shown for example in FIG. 1; and joining elements 5 with four connecting portions 6 and substantially cross-shaped, like the one shown for example in FIG. 9.

Figure 11:
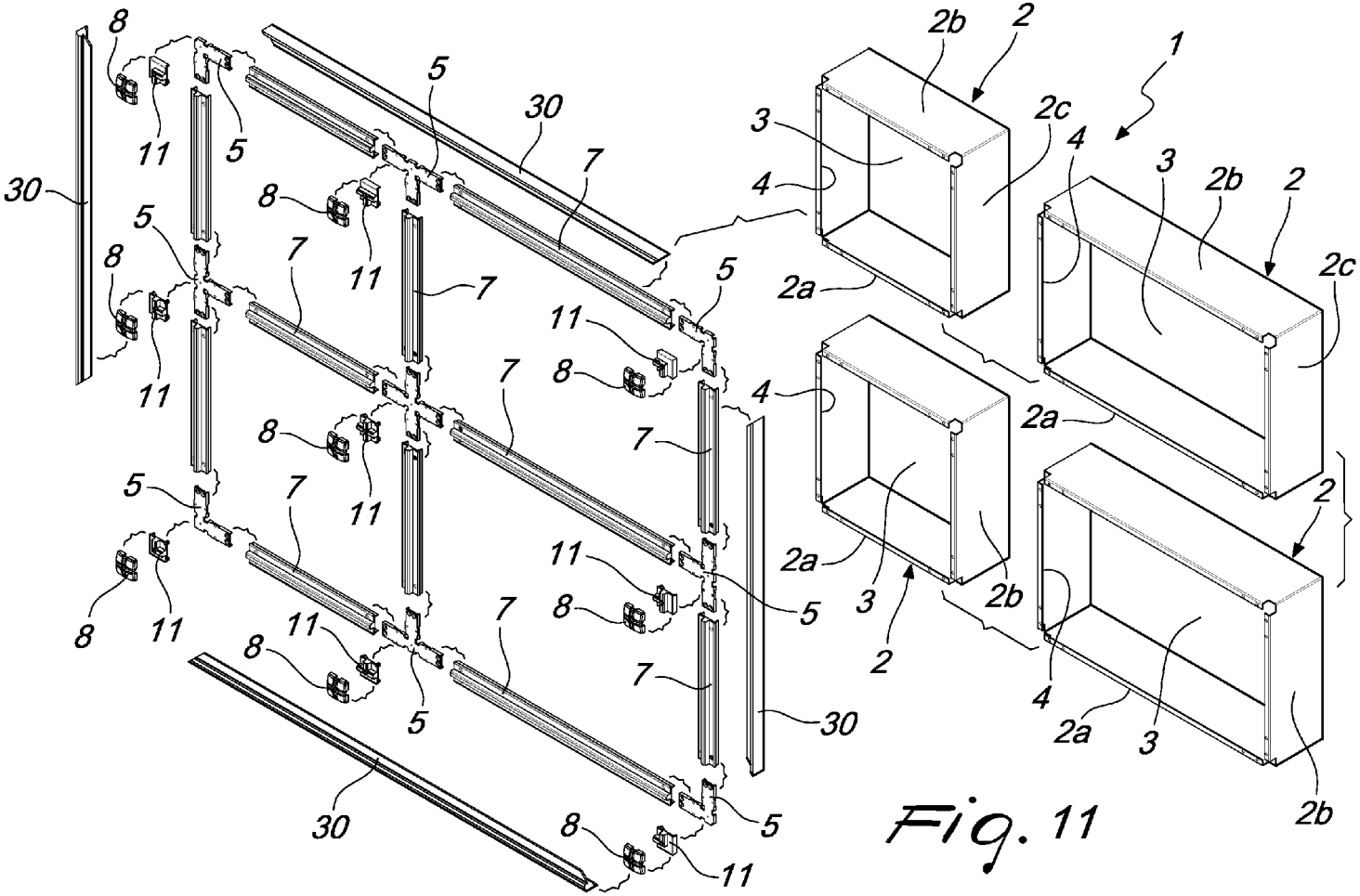
FIG. 11 is an exploded perspective view of a structure according to the invention.
Figure 12:
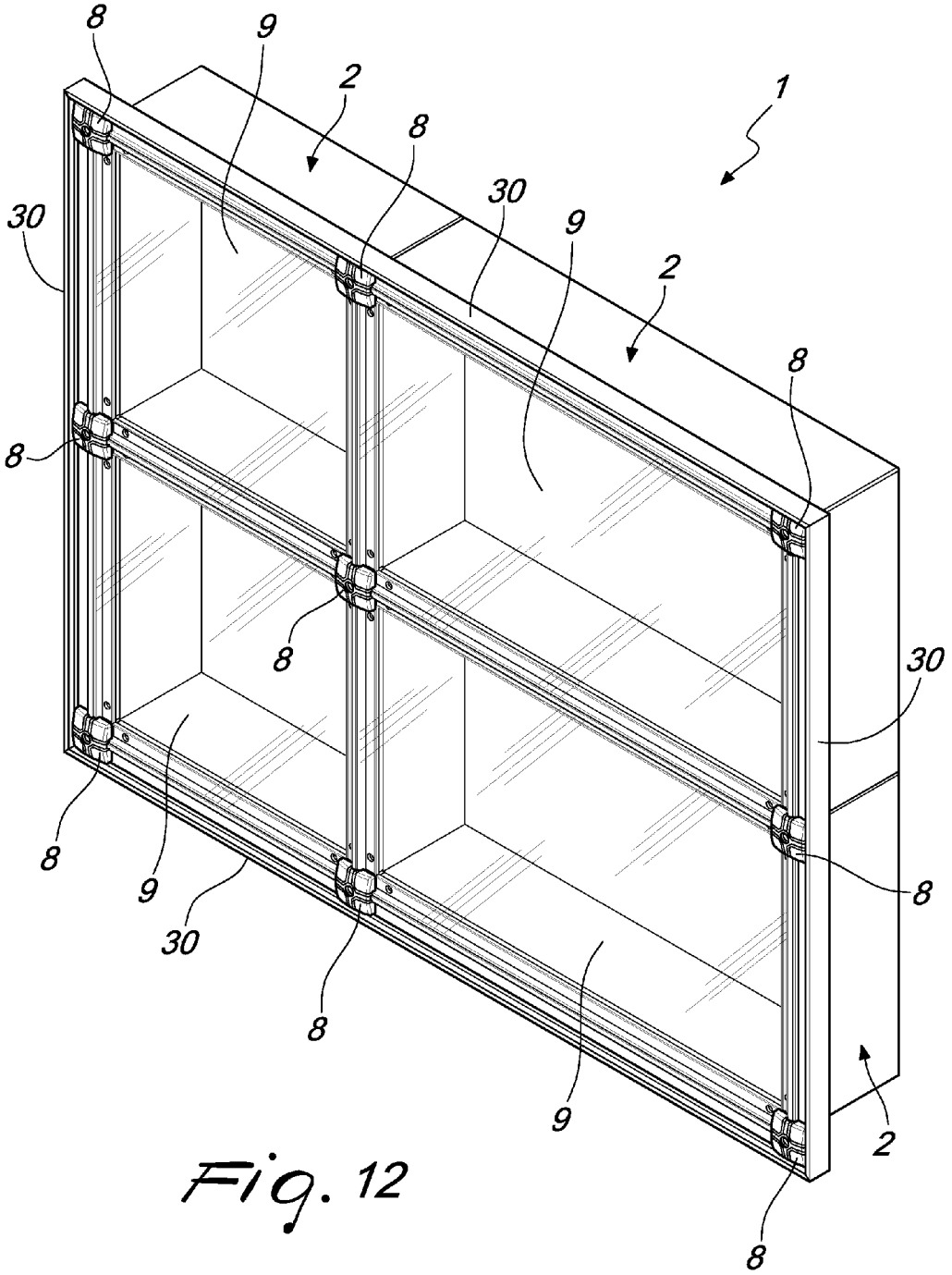
FIG. 12 is a perspective view of a structure according to the invention.

As can be seen, in particular, in FIG. 11 and in FIG. 12, the profiled finishing elements 7 are intended to be positioned around the openings 4 of the box-like bodies 2 and in such a way as to cover at least the connecting portions 6 of the joining elements 5.

Preferably, connector blocks 11 are positioned between the contiguous ends of the profiled finishing elements 7 and are, conveniently, fixed to a locking portion 12 defined by the joining elements 5 between the respective connecting portions 6.

Advantageously, at least one indentation 11*a* is defined on the connector blocks 11 and can engage corresponding abutment seats 12*a*, which are defined peripherally around the portion 12 for locking the joining elements 5, in order to allow the easy positioning of the connector blocks 11.

In order to carry out the fixing of the joining elements 5 to the front faces 2*c* of the box-like bodies 2, first holes 13 are, advantageously, defined in the connecting portions 6 of the joining elements 5 and accommodate first screws 14, which can be inserted from the outside of the box-like bodies 2.

At such first holes 13, there are engagement holes 15 for the first screws 14 in the box-like bodies 2. The fixing of the first screws 14 in the engagement holes 15 can be carried out by making the threading of the first screws 14 bite into the walls of the engagement holes 15 or by tightening a lock nut onto the first screws 14.

Conveniently, in the connecting portions 6 of the joining elements 5 there are, further, second holes 16 for accommodating second screws 17 which are adapted to fix profiled finishing elements 7 to the joining elements 5. The second screws 17 are, in particular, inserted, from the outside of the box-like bodies 2, into through holes 17*a* for locking, defined in the profiled members 7, and are screwed into the second holes 16 of the corresponding connecting portion 6 of the joining elements 5.

Optionally, in the position intended to be occupied by the second holes 16 of the joining elements 5 there can be, in the box-like bodies 2, further engagement holes 15*a* in which the second screws 17 can be inserted in order to allow a firmer fixing of the joining elements 5 to the box-like bodies 2.

Advantageously, at the corresponding portions 12 for locking the joining elements 5, there is also at least one third hole 18 for accommodating a third screw 19 which makes it possible to carry out the fixing of a respective connector block 11 to the joining elements 5.

It should be noted that, in order to allow a convenient assembly, the joining elements 5 are, conveniently, provided, at the connecting portions 6, with raised abutment portions 6*a*, 6*b*, mutually opposite, which are adapted to engage the edges of the openings 4 of two contiguous box-like bodies 2, so as to keep them close together, while the profiled elements 7 can, advantageously, have edgings in relief 7*a*, 7*b*, which are mutually opposite with respect to the axis of the profiled elements 7 and are adapted to abut against the mutually opposite edges of the connecting portions 6 of the joining elements 5.

Conveniently, as illustrated, in the connector blocks 11 at least one threaded engagement seat 20 can be defined into which a locking screw 21 can be inserted in order to fix a respective retention body 8, in which a corresponding through seat 8*a* is provided for the locking screw 21. In general, the threaded engagement seat 20 for screwing the locking screw 21 is defined coaxially and around a through hole 19*a* for inserting the third screw 19 defined in the connector block 11. Optionally, the same locking screw 21, of adequate length, can perform the function of the third screw 19, which will therefore be absent, and also allow the fixing of the connector block 11 to the locking portion 12 of the corresponding connecting element 5.

As shown, for example, in FIGS. 16 to 19, according to a possible embodiment, the third hole 18 can be axially provided at a coupling pin 31, protruding from the locking portion 12 of the joining elements 5 and insertable in a corresponding seat defined in the connector blocks 11. As shown, in particular, in FIG. 17, in this case, the connector blocks 11 and the abutment bodies 8 can, conveniently, be fixed to a corresponding connecting element 5 by way of a respective locking screw 21 which passes through the through seat 8*a* of the retention body 8 and the insertion through hole 19*a* of the connector block 11 in order to be screwed into a female thread defined in the third hole 18. It should be noted in particular that, although FIGS. 16-19 show a connecting element 5 which is substantially cross-shaped, the coupling pin 31 can, obviously, also be present on joining elements 5 which have other shapes.

Conveniently, the faces of the retention bodies 8 and of the connector blocks 11 which will be mutually coupled, i.e. which will face each other, are complementarily shaped with respect to each other, so as to obtain an easy assembly thereof.

Advantageously, there can optionally also be rear means for mutual connection between the box-like bodies 2, which are adapted to act on the rear side of the box-like bodies 2.

Figure 15:
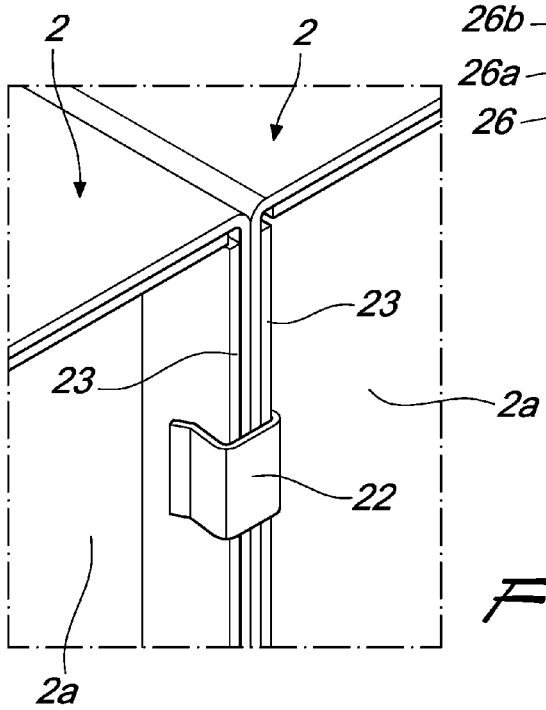
Figure 16:
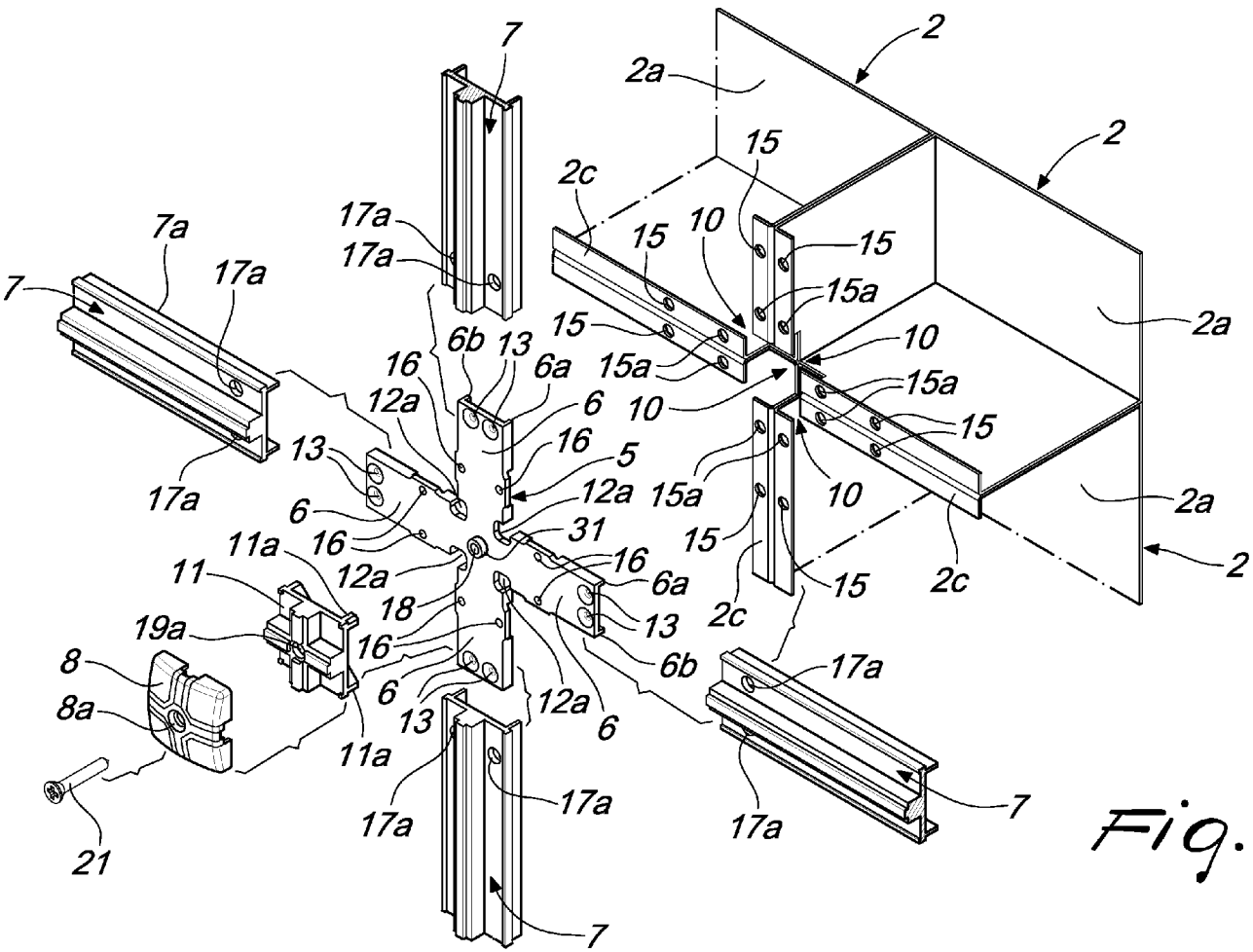
FIG. 16 is an exploded perspective view of several modular elements of the structure according to the invention, some shown partially in cross-section, in a possible embodiment.
Figure 17:
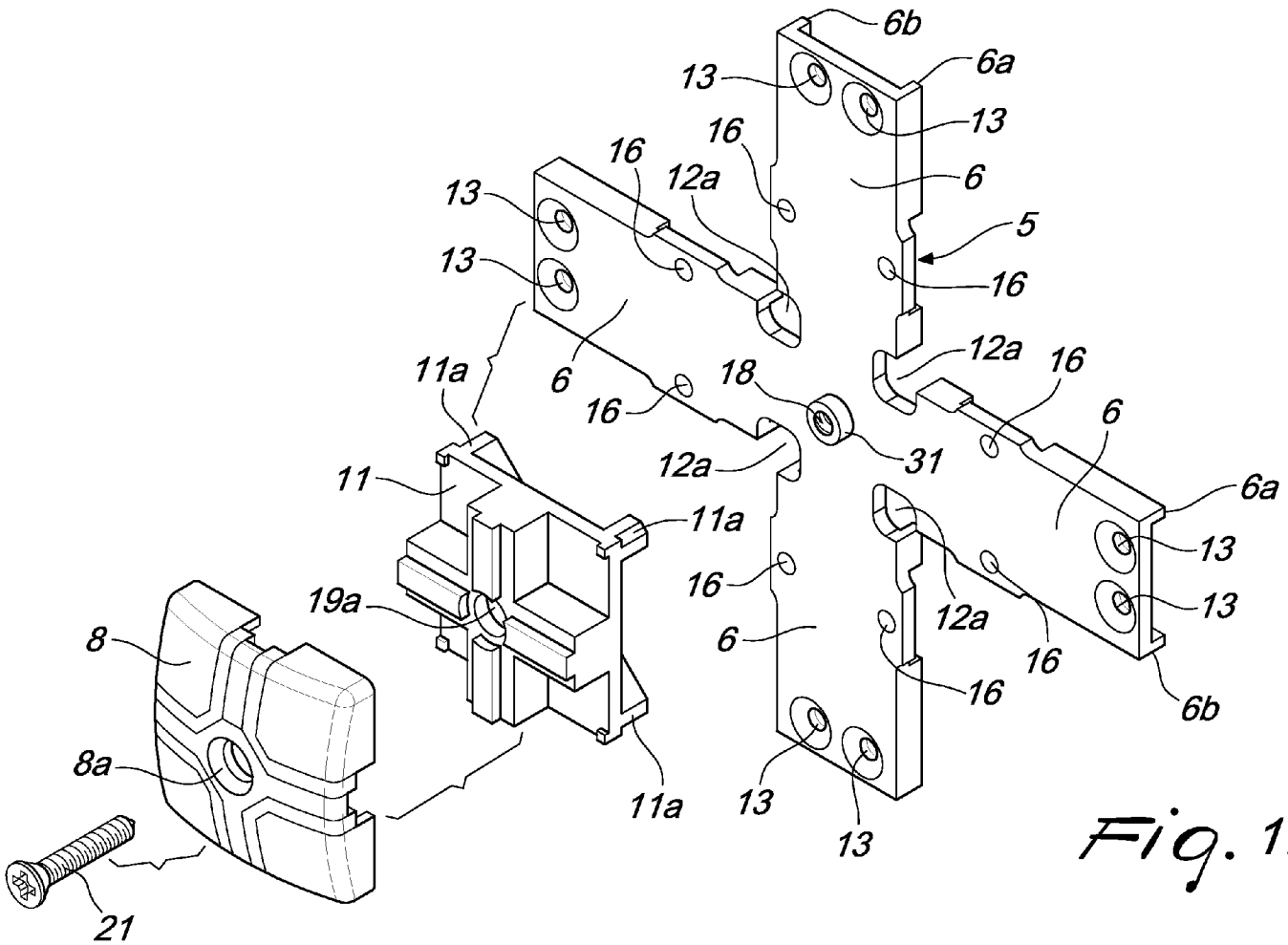
FIG. 17 is an exploded perspective view of the modular elements of the structure according to the invention, in the embodiment in FIG. 16.
Figure 18:
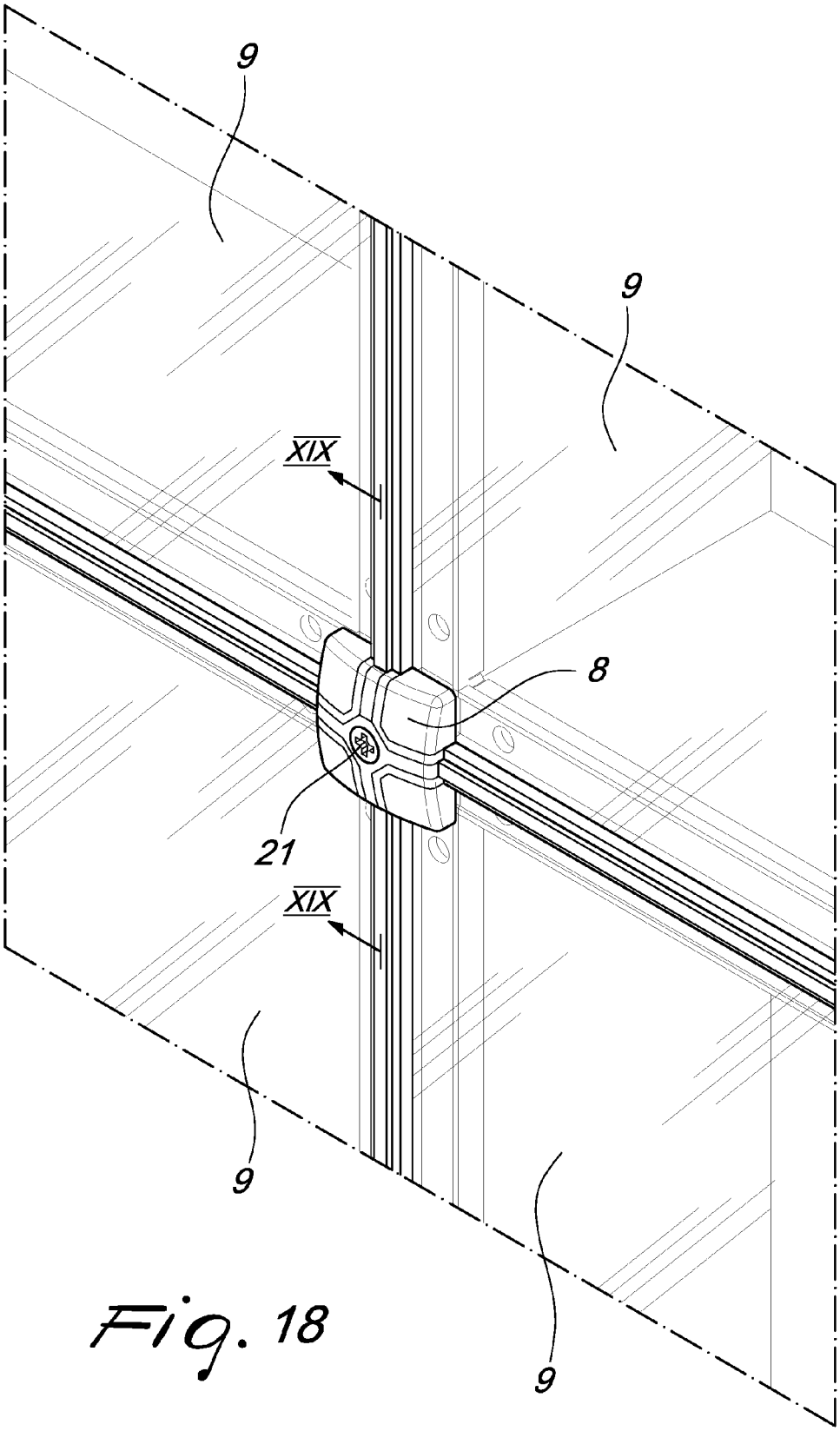
FIG. 18 is a perspective view of the modular elements of the structure according to the invention, in the embodiment in FIG. 16, mutually assembled.
Figure 19:
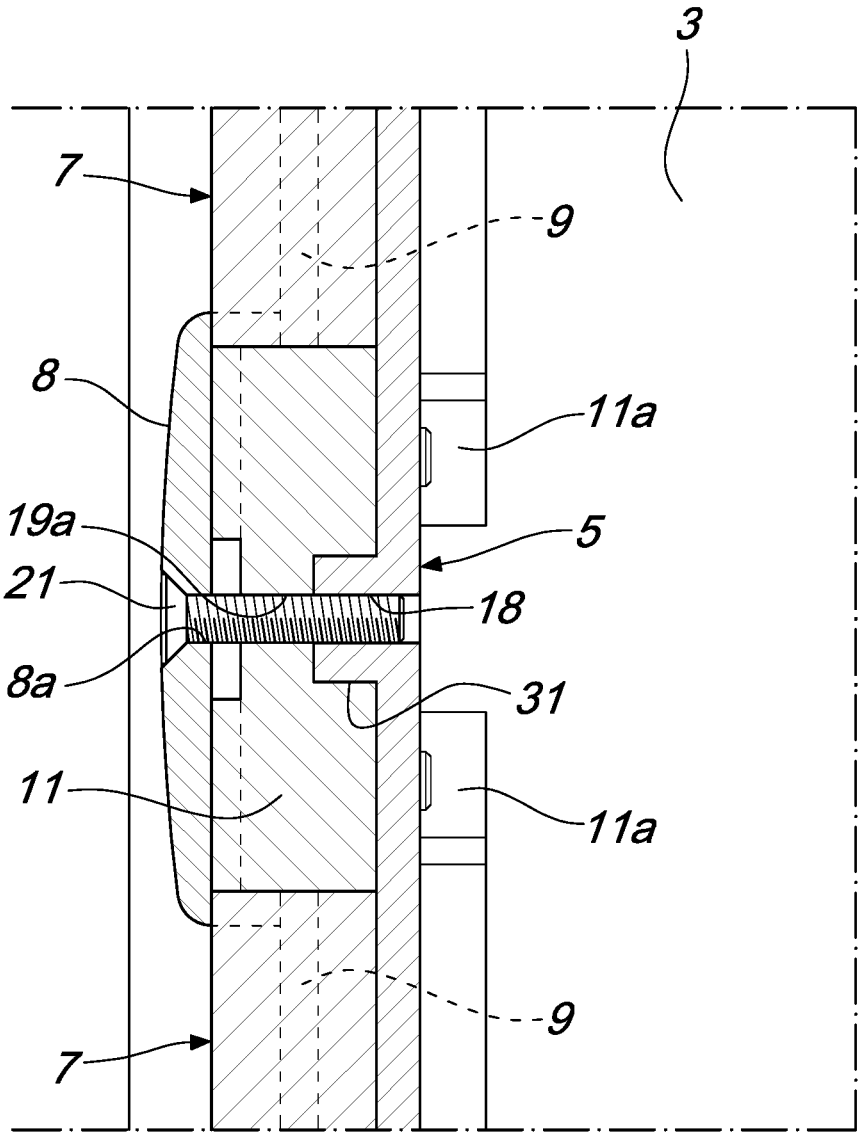
FIG. 19 is a cross-sectional view taken along the line XIX-XIX, in FIG. 18.

As illustrated for example in FIG. 15, such rear means for connection can be provided by clips 22, which can be engaged at perimetric wings 23 which protrude from the rear face 2*a* of the box-like bodies 2.

Figure 13:
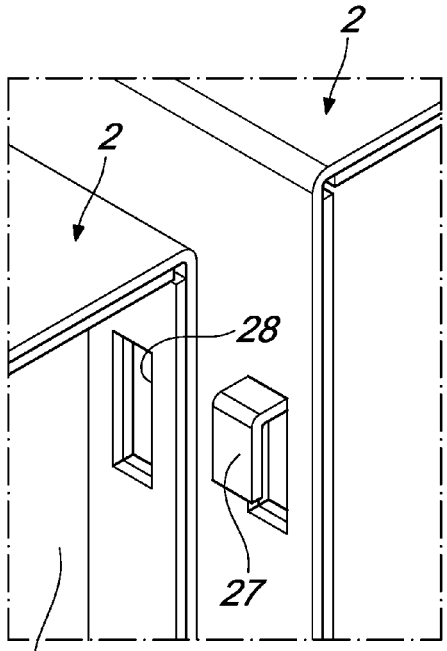
FIGS. 13, 14 and 15 are perspective views of different solutions for mutual connection, on the rear side thereof, of box-like bodies that make up the structure according to the invention.
Figure 14:
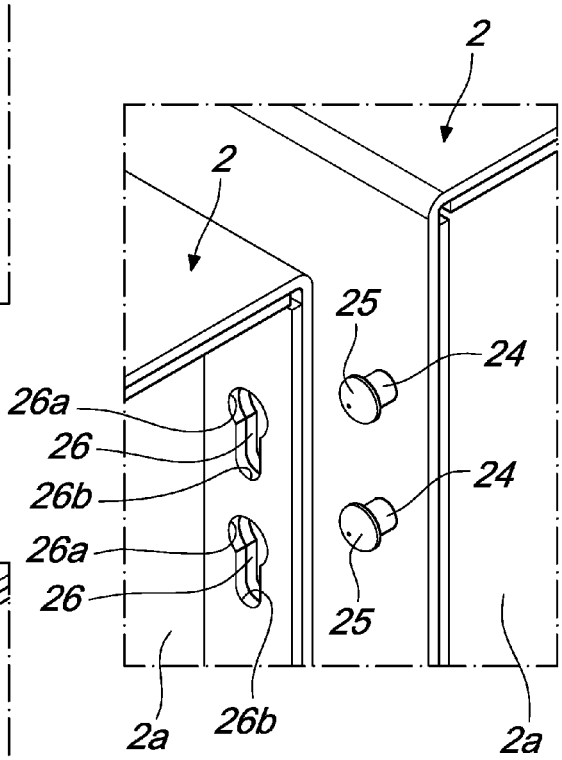

Alternatively, the rear means for connection can be constituted by mutually interlocking elements of the male-female type. In such case, for example, such interlocking elements can be provided by at least one pin 24 with an enlarged head 25, provided on one side to be joined of the box-like bodies 2 and engageable in a corresponding elongated seat 26, defined on the facing side of the box-like bodies 2 and provided with a passing portion 26*a* for the enlarged head 25 which is connected to an engagement portion 26*b* for the pin 24, smaller in size than the passing portion 26*a*, as shown in FIG. 14. According to another possible example, shown in FIG. 13 the interlocking elements can comprise at least one coupling tab 27, arranged on a side to be joined of the box-like bodies 2 and removably insertable in an engagement slit 28 defined on the other side of the box-like bodies 2, in order to allow the mutual mating of the box-like bodies 2 side by side.

It should be noted that the rear means for connection can, optionally, also be provided by screws, rivets or the like.

To complete the structure according to the invention, there can further be framing profiles 30 which are intended to be positioned around the external perimeter of the front part of the structure and are kept in the locked position by way of the clamping thereof between corresponding profiled elements 7 and corresponding retention bodies 8.

Use of the structure according to the invention is the following.

The user proceeds to choose the several box-like bodies 2 and arranges them mutually adjacent, both vertically and horizontally, according to the preset configuration.

In order to mutually connect the box-like bodies 2 once arranged thus, the joining elements 5 of the adapted shape, according to their position for use, are fixed to the front face of the box-like bodies 2, by screwing, from the outside of the box-like bodies 2, the first screws 14 into the first holes 13 in the connecting portion 6 of the joining elements 5 and into the corresponding engagement holes 15 in the box-like bodies 2.

In order to connect four box-like bodies 2 in the mutually adjacent corner areas, for example, the substantially cross-shaped joining elements 5 are used, while the substantially T-shaped joining elements 5 can be used to connect together two box-like bodies 2 which are arranged at the peripheral region of the structure and, in turn, the substantially L-shaped joining elements 5 can be fixed in the corner areas of the box-like bodies 2 that are located at the perimetric corners of the structure, in order to allow the subsequent fixing of corresponding profiled finishing elements 7.

At this point, the profiled elements 7 are fixed to the joining elements 5, by inserting the second screws 17 into their through holes 17*a* for locking and screwing them into the second holes 16 of the corresponding connecting portion 6 of the joining elements 5.

The connector blocks 11 are fixed to the locking portions 12 of the joining elements 5, by inserting the third screws 19 into the corresponding insertion through holes 19*a* provided in the connector blocks 11 and then screwing them into the third hole 18 defined in the locking portion 12 of the corresponding joining elements 5.

Subsequently, the closing plates 9 of the openings 4 of the box-like elements 2 are put in place, by placing them at the edges of the profiled finishing elements 7, and they are locked in position, fixing the retention bodies 8 with the associated locking screws 21 which are screwed into the threaded engagement seat 20 defined in the corresponding connector block 11.

Optionally, framing profiles 30 are interposed between profiled finishing elements 7 and retention bodies 8, so as to obtain a completed structure, like the one shown, for example, in FIG. 12.

In practice it has been found that the invention is capable of fully achieving the set aim and objects, in that it makes it possible to use modular elements to provide a structure for containing cinerary urns and/or funerary items in an extremely practical and simple manner.

All the characteristics of the invention, indicated above as advantageous, convenient or similar, may also be missing or be substituted by equivalent characteristics.

The individual characteristics set out in reference to general teachings or to specific embodiments may all be present in other embodiments or may substitute characteristics in such embodiments.

The invention, thus conceived, is susceptible of numerous modifications and variations, all of which are within the scope of the appended claims.

In practice the materials employed, provided they are compatible with the specific use, and the dimensions and shapes, may be any according to requirements.

Moreover, all the details may be substituted by other, technically equivalent elements.

What is claimed is:

1. A funerary structure for containing cinerary urns and funerary items, wherein said structure comprises a plurality of modular elements comprising:

a plurality of box-shaped bodies, each one of the box-shaped bodies defining, within said each one of the box-shaped bodies, at least one corresponding niche for accommodating at least one cinerary urn and/or at least one funerary item, and having a rear face, side faces, and a front face which is provided with at least one access opening to the corresponding niche, said box-shaped bodies arranged mutually adjacent, with their side faces, along at least two mutually perpendicular directions;

a plurality of joining elements for mutually joining said box-shaped bodies, which have at least one connecting portion fixed to the front face of the box-shaped bodies arranged mutually adjacent;

a plurality of profiled finishing elements covering said joining elements at least partially; and a plurality of retention bodies fixed with respect to said box-shaped bodies and peripherally engaging closing plates, which respectively close the openings of said box-shaped bodies.

2. The funerary structure according to claim 1, wherein said joining elements are adapted to mutually connect corner areas of the front faces of the box-shaped bodies arranged mutually adjacent.

3. The funerary structure according to claim 1, wherein said joining elements each have at least two connecting portions which extend substantially at right angles to each other and each of which can be fixed to respective areas of the front face of said box-shaped bodies.

4. The funerary structure according to claim 3, further comprising a plurality of connector blocks intended to be arranged between contiguous ends of said profiled finishing elements and intended to be fixed to a portion for locking said joining elements interposed between said connecting portions.

5. The funerary structure according to claim 4, wherein said joining elements have, on said connecting portions, first holes for accommodating first screws, which can be inserted from an outside of said box-shaped bodies and are adapted to fix said joining elements to the front faces of said box-shaped bodies, and second holes for accommodating second screws adapted to fix said profiled finishing elements to said joining elements.

6. The funerary structure according to claim 5, wherein said joining elements have, at corresponding locking portions, at least another hole for accommodating a third screw for fixing a respective connector block.

7. The funerary structure according to claim 4, wherein in said connector blocks there is at least one engagement seat for a locking screw of a respective retention body.

8. The funerary structure according to claim 4, wherein said connector blocks have at least one indentation adapted to engage corresponding abutment seats defined peripherally around the portion for locking said joining elements.

9. The funerary structure according to claim 4, wherein said joining elements comprise, at said connecting portions, raised abutment portions, which are mutually opposite and adapted to engage edges of the openings of two contiguous box-shaped bodies.

10. The funerary structure according to claim 4, wherein said profiled finishing elements have edgings in relief, mutually opposite with respect to an axis of said profiled finishing elements and adapted to abut against mutually opposite edges of the connecting portions of said joining elements.

11. The funerary structure according to claim 1, further comprising means for mutual connection between said box-shaped bodies, which are adapted to act on the rear face of said box-shaped bodies.

* * * * *